US011581158B2

(12) United States Patent
Mantoan

(10) Patent No.: US 11,581,158 B2
(45) Date of Patent: Feb. 14, 2023

(54) COIL SUPPORT STRUCTURE AND METHOD OF RETAINING PCBA OF A RELAY

(71) Applicant: Littelfuse, Inc., Chicago, IL (US)

(72) Inventor: Davide Mantoan, Legnago (IT)

(73) Assignee: Littelfuse, Inc., Chicago, IL (US)

( * ) Notice: Subject to any disclaimer, the term of this patent is extended or adjusted under 35 U.S.C. 154(b) by 163 days.

(21) Appl. No.: 17/070,217

(22) Filed: Oct. 14, 2020

(65) Prior Publication Data

US 2022/0115201 A1 Apr. 14, 2022

(51) Int. Cl.

| | |
|---|---|
| ***H01H 50/02*** | (2006.01) |
| ***H01H 50/44*** | (2006.01) |
| ***H01H 47/22*** | (2006.01) |
| ***H01H 50/64*** | (2006.01) |

(52) U.S. Cl.

CPC ..... *H01H 50/02* (2013.01); *H01H 47/226* (2013.01); *H01H 50/44* (2013.01); *H01H 50/641* (2013.01)

(58) Field of Classification Search

CPC ..... H01H 50/02; H01H 47/226; H01H 50/44; H01H 50/641; H01H 50/16; H01H 50/021; H01H 50/042; H01H 2050/446; H01H 2050/046; H01H 51/01

See application file for complete search history.

(56) References Cited

U.S. PATENT DOCUMENTS

| | | | | |
|---|---|---|---|---|
| 5,808,533 | A * | 9/1998 | Buscher | H01H 50/021 335/202 |
| 6,064,289 | A | 5/2000 | Wieloch et al. | |
| 6,204,740 | B1 | 3/2001 | Nakahata | |
| 6,233,131 | B1 * | 5/2001 | Kappel | H01H 50/30 361/170 |
| 7,564,335 | B1 * | 7/2009 | Yang | H01F 27/29 336/192 |
| 2001/0026206 | A1 * | 10/2001 | Maeda | H01F 27/027 336/198 |
| 2002/0060619 | A1 | 5/2002 | Mani et al. | |
| 2002/0135447 | A1 | 9/2002 | Gruner | |
| 2003/0030531 | A1 * | 2/2003 | Okano | H01F 27/2828 336/198 |
| 2009/0121815 | A1 | 5/2009 | Ota et al. | |

OTHER PUBLICATIONS

Extended European Search Report dated Feb. 22, 2022 for corresponding European Patent Application No. 21201764.4.

* cited by examiner

*Primary Examiner* — Bernard Rojas

(74) *Attorney, Agent, or Firm* — KDB Firm PLLC

(57) ABSTRACT

Provided herein are coil support structures and methods of retaining a printed circuit board assembly (PCBA) of a relay. In some embodiments, a bi-stable relay assembly may include a coil support structure, having a central section extending between a first end section and a second end section, and set of biasable fasteners extending from the first end section and the second end section, wherein each of the set of biasable fasteners includes a sloped engagement surface and a retention slot. The coil support structure may further include a PCBA coupled to the first and second end sections of the coil support structure, wherein the coil support structure extends within the retention slot of each of the set of biasable fasteners.

23 Claims, 8 Drawing Sheets

COIL SUPPORT STRUCTURE AND METHOD OF RETAINING PCBA OF A RELAY

FIELD OF THE DISCLOSURE

The disclosure relates generally to the field of circuit protection devices and, more particularly, to a coil support structure and method of retaining a printed circuit board assembly (PCBA) of a relay.

BACKGROUND OF THE DISCLOSURE

Electrical relays are devices that enable a connection to be made between two electrodes in order to transmit a current. Some relays include a coil and a magnetic switch. When current flows through the coil, a magnetic field is created proportional to the current flow. At a predetermined point, the magnetic field is sufficiently strong to pull the switch's movable contact from its rest, or de-energized position, to its actuated, or energized position pressed against the switch's stationary contact. When the electrical power applied to the coil drops, the strength of the magnetic field drops, releasing the movable contact and allowing it to return to its original de-energized position. A normally open relay, for example, is a switch that keeps its contacts closed while being supplied with the electric power and that opens its contacts when the power supply is cut off.

Some relays include a coil support and integrated PCBA. Currently, PCBAs are fixed to the coil support by screwing, riveting and similar. Therefore, what is needed is a simplified coil support and PCBA, which reduces part complexity and reduces assembly time.

SUMMARY OF THE DISCLOSURE

The Summary is provided to introduce a selection of concepts in a simplified form, the concepts further described below in the Detailed Description. The Summary is not intended to identify key features or essential features of the claimed subject matter, nor is the Summary intended as an aid in determining the scope of the claimed subject matter.

In one approach according to the present disclosure, a bi-stable relay assembly may include a coil support structure, having a central section extending between a first end section and a second end section, and a set of biasable fasteners extending from the first end section and the second end section, each of the set of biasable fasteners including a sloped engagement surface and a retention slot. The b-stable relay may further include a printed circuit board assembly (PCBA) coupled to the first and second end sections of the coil support structure, wherein the coil support structure extends within the retention slot of each of the set of biasable fasteners.

In another approach according to the present disclosure, a coil support structure for a relay may include a central section extending between a first end section and a second end section, wherein a first coil and a second coil are operable to be wound about the central section, and a set of biasable fasteners extending from the first end section and the second end section, each of the set of biasable fasteners including a sloped engagement surface and a retention slot, wherein a perimeter of a printed circuit board is operable to extend within the retention slot of each of the set of biasable fasteners.

In yet another approach according to the present disclosure, a method of assembling a bi-stable relay may include winding a first coil and a second coil about a coil support structure, the coil support structure comprising a central section extending between a first end section and a second end section, wherein the first and second coils are wound about the central section, and a set of biasable fasteners extending from the first end section and the second end section, each of the set of biasable fasteners including a sloped engagement surface and a retention slot. The method may further include coupling a printed circuit board assembly (PCBA) to the first and second end sections of the coil support structure, wherein a printed circuit board of the PCBA extends within the retention slot of each of the set of biasable fasteners.

BRIEF DESCRIPTION OF THE DRAWINGS

The accompanying drawings illustrate exemplary approaches of the disclosed embodiments so far devised for the practical application of the principles thereof, and in which.

Figure 1:
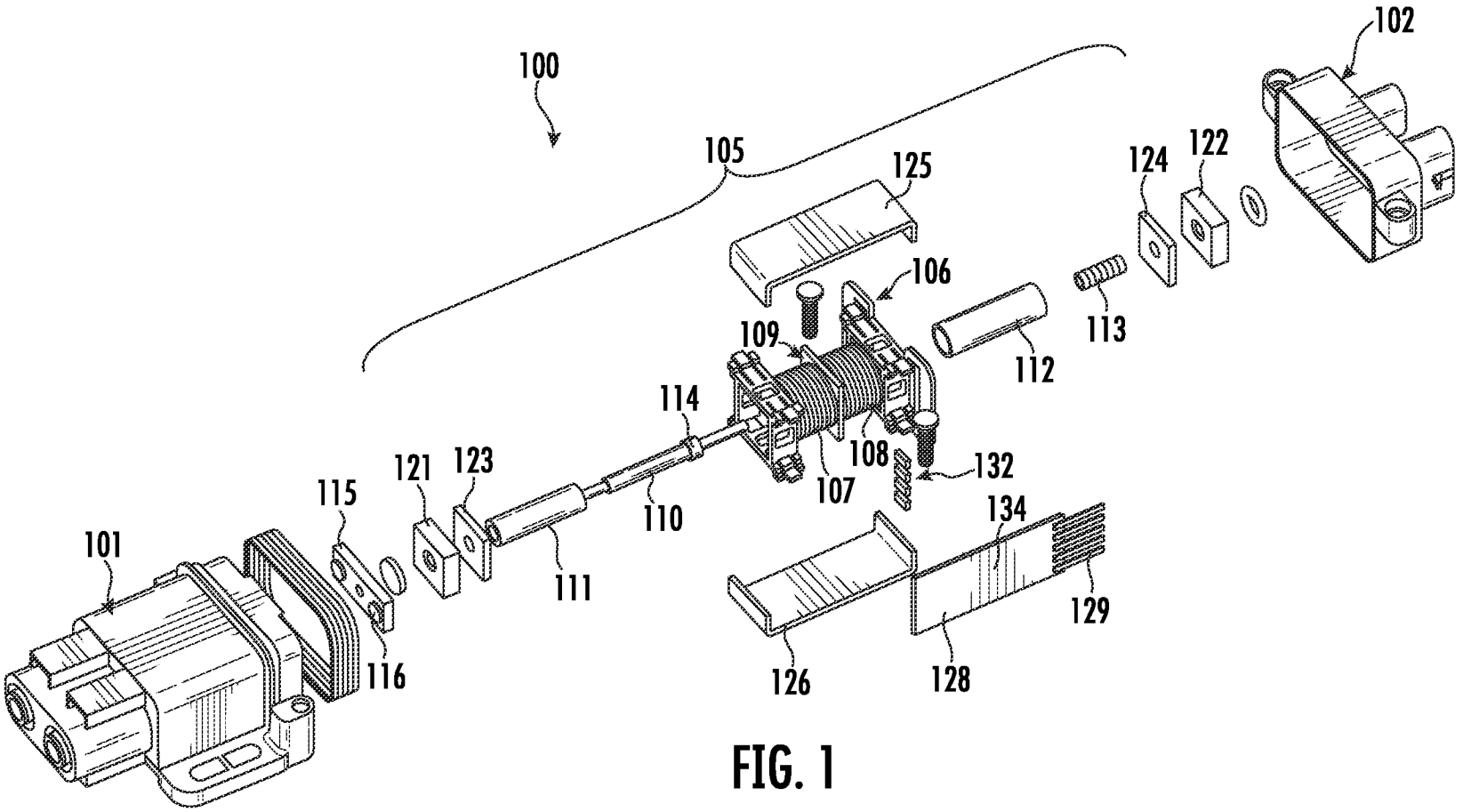
FIG. 1 depicts an exploded perspective view of an assembly according to embodiments of the present disclosure.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity. Furthermore, for clarity, some reference numbers may be omitted in certain drawings.

DETAILED DESCRIPTION

Assemblies, devices, and methods in accordance with the present disclosure will now be described more fully hereinafter with reference to the accompanying drawings. The Assemblies, devices, and methods may be embodied in many different forms and should not be construed as being limited to the embodiments set forth herein. Rather, these embodiments are provided so that this disclosure will be thorough and complete, and will fully convey the scope of the system and method to those skilled in the art.

As will be described herein, embodiments of the present disclosure are directed to relays including a multi-part core shell held together by a magnetic force from one or more permanent magnets of the core. Advantageously, fewer fastening components (e.g., screws, rivets or the like) are required, thus saving time during assembly. Furthermore, relays of the present disclosure include two coils, wound around a coil support structure, each one close to one of the two fixed magnets. The core shell, which may include made two or more parts made from ferromagnetic material, provide a path through which a magnetic field can flow. In some embodiments, each of the fixed cores may correspond to a stable position (e.g., ON/OFF) of the switch. During operation, the coils and magnets attract a mobile core (e.g., plunger and contact plate), retaining the mobile core in a stable position. The coils, when activated, change the whole magnetic field, e.g., by increasing or decreasing the magnetic field in one side of the magnet, in this way letting the mobile core move by attraction to the higher magnetic field.

FIG. 1 illustrates an exploded view of a bi-stable relay assembly (hereinafter "assembly") 100 according to embodiments of the present disclosure. As shown, the assembly may include a housing made up of a first housing part 101 coupleable with a second housing part 102. The assembly 100 may further include a core assembly 105, including a coil support structure (hereinafter "support structure") 106, and a first coil 107 and a second coil 108 wound about a central section 109 of the support structure 106. Extending through the support structure 106 is a plunger 110, a first core shaft 111, and a second core shaft 112. When assembled, a spring 113 may be positioned within the first core shaft 111, e.g., against a flange 114 of the plunger 110, to bias a contact plate 115. As shown, the contact plate 115 may include one or more contacts 116.

At one end, the core assembly 105 may include a first magnet 121 and a first ferromagnetic plate 123 couplable with the support structure 106. At another end, the core assembly 105 may include a second magnet 122 and a second ferromagnetic plate 124 couplable with the support structure 106. Although shown as being cuboid-shaped, it will be appreciated that the first magnet 121, the second magnet 122, the first ferromagnetic plate 123 and the second ferromagnetic plate 124 may take on different shapes in alternative embodiments.

The core assembly 105 may further include a shell comprising a first electromagnetic shell component (hereinafter "first shell component") 125 and a second electromagnetic shell component (hereinafter "second shell component") 126 coupled to the support structure 106. In some embodiments, the first and second electromagnetic shell components 125, 126 are each made from a ferromagnetic material. As will be described in greater detail herein, the first and second shell components 125, 126 may be held in position by magnetic forces from the first and second magnets 121, 122.

The contact plate 115, the first and second coils 107, 108, the contacts 116, and the plunger 110 may be formed of any suitable, electrically conductive material. In some embodiments, the first and second coils 107, 108 may be copper or tin, and/or may be formed as a wire, a ribbon, a metal link, a spiral wound wire, a film, or an electrically conductive core deposited on a substrate. The conductive materials may be decided based on fusing characteristic and durability. In one embodiment, the plunger 110 and the contacts 116 are stainless steel.

The core assembly 105 may further include a PCBA, which includes one or more printed circuit boards (PCBs) 128 and associated pins 129. In some embodiments, the PCB 128 may be coupled to the support structure 106 by one or more conductive connectors 132, which connect the PCB 128 with the first and second coils 107, 108 when, for example, electrical current is flowing. As shown, the connectors 132 may extend through corresponding PCB openings 134 of the PCB 128.

Figure 2A:
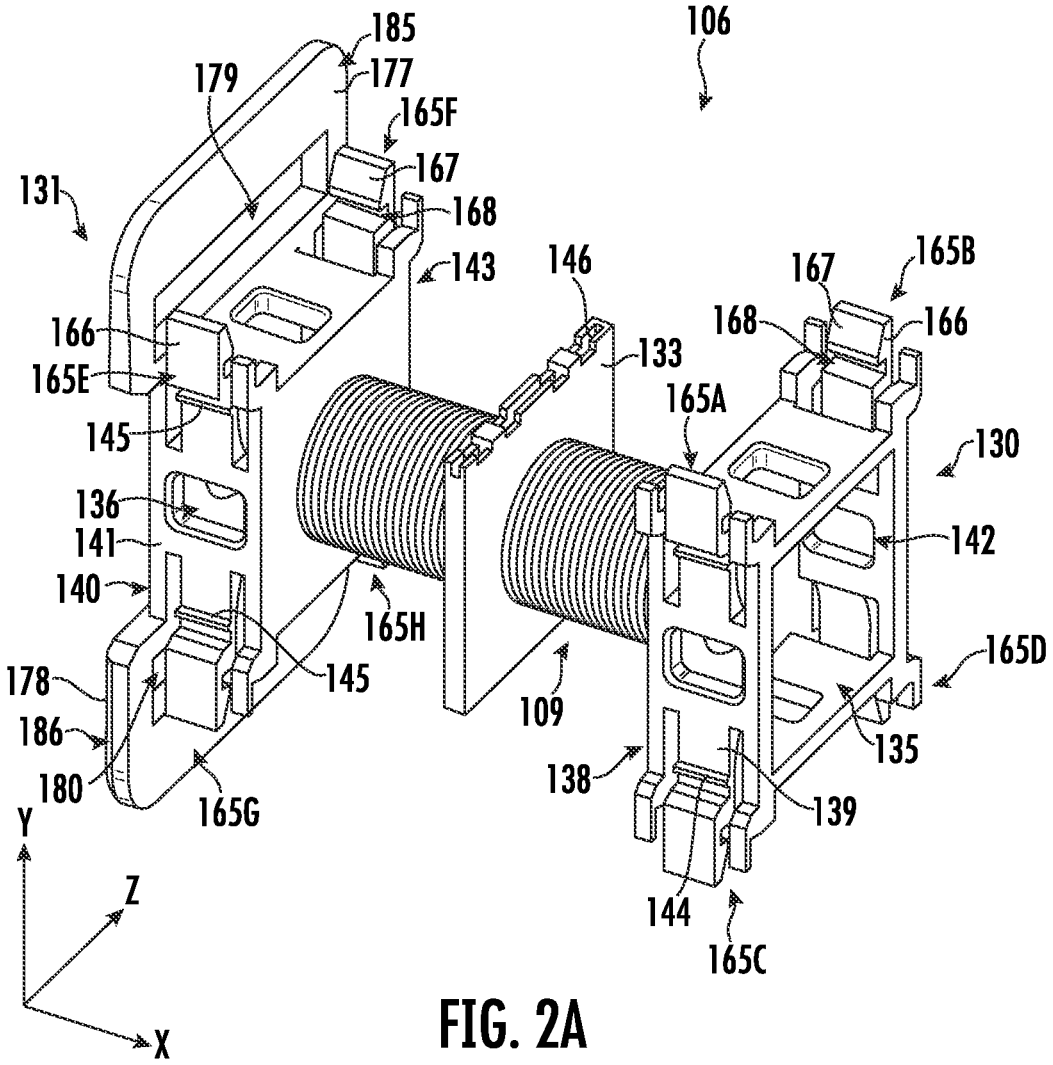
FIG. 2A and FIG. 2B depicts a perspective view of a support structure of the assembly of FIG. 1 according to embodiments of the present disclosure.
Figure 2B:
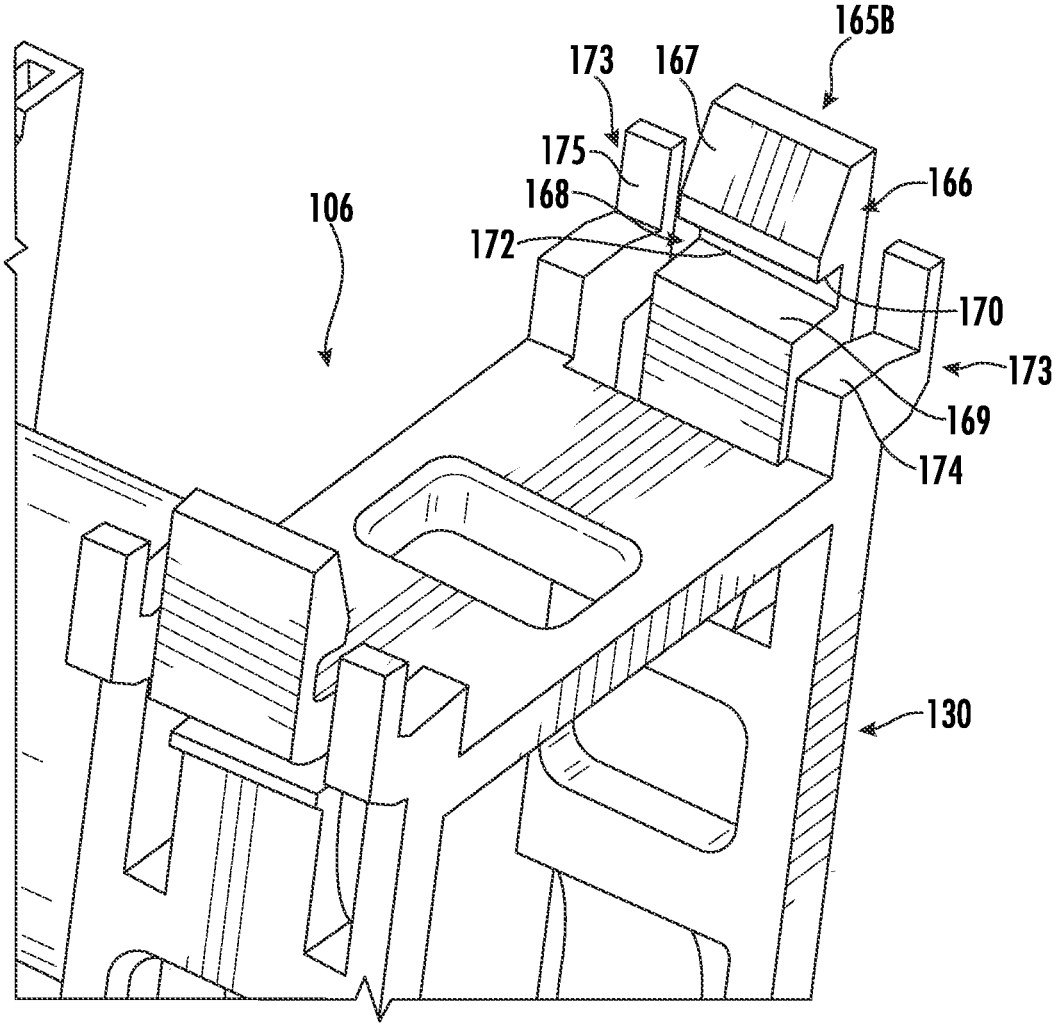

Turning now to FIGS. 2A-2B, the support structure 106 according to embodiments of the present disclosure will be described in greater detail. As shown, the support structure 106 may include a first end section 130 and a second end section 131 connected at opposite ends of the central section 109. The central section 109 may be a cylinder sectioned into two halves by a separator plate 133. The separator plate 133 may be positioned between the first and second coils 107, 108 (FIG. 1). In other embodiments, the central section 109 may take on a different shape/profile. As shown, the separator plate 133 may include a plurality of slots or openings 146 operable to receive the conductive connectors 132 (FIG. 1).

In some embodiments, the first magnet 121 and the first ferromagnetic plate 123 may be positioned within a first interior cavity 135 defined by the first end section 130. Similarly, the second magnet 122 and the second ferromagnetic plate 124 may be positioned within a second interior cavity 136 defined by the second end section 131. In some embodiments, the first ferromagnetic plate 123 is positioned between the first magnet 121 and the first coil 107, and the second ferromagnetic plate 124 is positioned between the second magnet 122 and the second coil 108.

The first end section 130 may include a first end first recess 138 defined in part by a first recess surface 139. Similarly, the second end section 131 may include a second end first recess 140 defined in part by a second recess surface 141. Once assembled, the first shell component 125 may be positioned within the first end first recess 138 and within the second end first recess 140. On an opposite side, the first end section 130 may include a first end second recess 142, and the second end section 131 may include a second end second recess 143. The second shell component 126 may be positioned within the first end second recess 142 and within the second end second recess 143. One or more ridges 144 of the first end section 130, and one or more ridges 145 of the second end section 131, may be in contact with the first shell component 125. Although not shown, ridges or other alignment features may similarly be provided along the first end second recess 142 and the second end second recess 143 for engagement with the second shell component 126.

As further shown, the support structure 106 may include a plurality of biasable fasteners 165A-165H. In exemplary embodiments, each of the plurality of biasable fasteners 165A-165H includes a snap-fit or press-fit tab. The first end section 130 may include fasteners 165A, 165B generally extending above the first interior cavity 135, and fasteners 165C, 165D generally extending below the first interior cavity 135. Similarly, the second end section 131 may include fasteners 165E, 165F generally extending above the second interior cavity 136, and fasteners 165G, 165H generally extending below the second interior cavity 136. It will be appreciated that a greater or fewer number of fasteners may be present in other embodiments.

As shown, the fasteners 165A-165H may each include an arm 166 extending away from the central section 109 along a first direction or plane (e.g., y-axis). Each arm 166 may include a sloped engagement surface 167 adjacent a retention slot 168. The sloped engagement surface 167 may define a second plane, which is oriented non-parallel relative to the plane of the arm 166. Said another way, each arm 166 may have a varied thickness, for example, along the z-axis. During assembly of the core assembly 105, the PCB 128 is pressed towards the central section 109. A perimeter of the PCB may engage the sloped engagement surface 167, which causes the arms 166 to deflect outwardly (e.g., along the z-axis) as the PCB 128 moves closer to the central section 109. For example, fastener 165A and fastener 165B may deflect away from one another. Once the PCB 128 enters each retention slot 168, the PCB 128 is no longer engaged with the sloped engagement surfaces 167, and the arms 166 are therefore permitted to relax back into the vertical, or substantially vertical, position. For example, fastener 165A and fastener 165B may rotate towards one another.

As better shown in FIG. 2B, the retention slot 168 may be defined by a base surface 169 opposite an upper surface 170. In some embodiments, the base surface 169 and the upper surface 170 extend parallel to one another. Once the PCB 128 is coupled to the coil support structure 106, the base surface 169 is operable to engage a first main side (e.g., bottom) of the PCB 128, while the upper surface 170 may be positioned directly adjacent a second main side (e.g., top) of the PCB 128. The upper surface 170 may prevent the PCB 128 from being lifted away from the coil support structure 106. As further shown, the retention slot 168 may be further defined by a sidewall surface 172, which is configured to engage an outer edge or perimeter of the PCB 128.

In some embodiments, one or more of fasteners 165A-165H may include a set of support posts 173 adjacent the arm 166. Each support post 173 may include a post base surface 174 connected with a post sidewall surface 175. The post base surface 174 may be operable to engage the first main side of the PCB 128, while the post sidewall surface 175 may be operable to engage the outer edge or perimeter of the PCB 128. In some embodiments, the post base surface 174 is co-planar with the base surface 169 of the arm 166. In other embodiments, the post base surface 174 and the base surface 169 extend parallel to one another. Unlike the arm 166, the support posts 173 may be substantially rigid to prevent deflection.

Referring again to FIG. 2A, the second end section 131 of the support structure 106 may further include a first end wall 185 adjacent fasteners 165E, 165F and a second end wall 186 adjacent fasteners 165G, 165H. Although non-limiting, the first and second end walls 185, 186 may each include an inner main surface 177 opposite an outer main surface 178. A first opening 179 may be formed through the first end wall 185 and a second opening 180 may be formed through the second end wall 186. The PCB 128 may extend through the first opening 179, for example, as demonstrated in FIG. 3. Although not shown, a second PCB may be coupled to fasteners 165C, 165D, 165G, and 165H, and may extend through the second opening 180.

Figure 3:
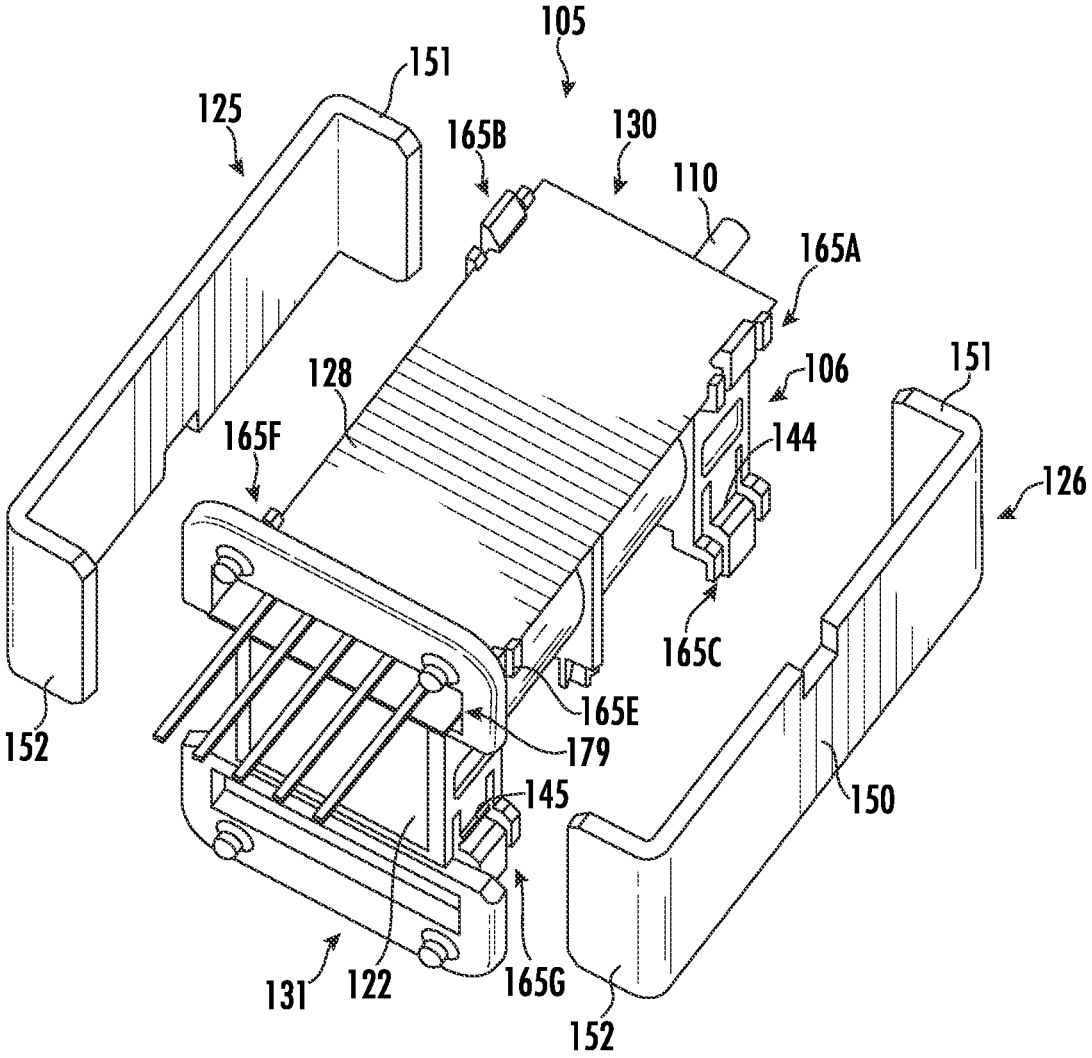
FIG. 3 is a partially exploded perspective view of a core of the assembly of FIG. 1 according to embodiments of the present disclosure.

FIG. 3 further demonstrates the first and second shell components 125, 126 in a disconnected arrangement according to embodiments of the present disclosure. As shown, the first and second shell components 125, 126 may each include a main body 150 extending between the first end section 130 and the second end section 131 of the support structure 106. The first and second shell components 125, 126 may further include a first end portion 151 and a second end portion 152 extending from the main body 150. The first and second end portions 151, 152 may extend perpendicular/transverse to the main body 150 for contact with the first and second magnets 121, 122. It will be appreciated that the first and second shell components 125, 126 may take on a variety of different shapes/configurations in other embodiments.

During assembly, the first and second shell components 125, 126 may be coupled to the support structure 106 after the PCB 128 is coupled to the support structure 106. Advantageously, due to the electromagnetic attraction between the first and second shell components 125, 126 and the first and second magnets 121, 122, the first and second shell components 125, 126 will press against the ridges 144 of the first end section 130 and the ridges 145 of the second end section 131 to act as a secondary lock to prevent the fasteners 165A-165H from deflecting/opening during operation of the core assembly 105 (e.g., due to vibration).

Figure 4:
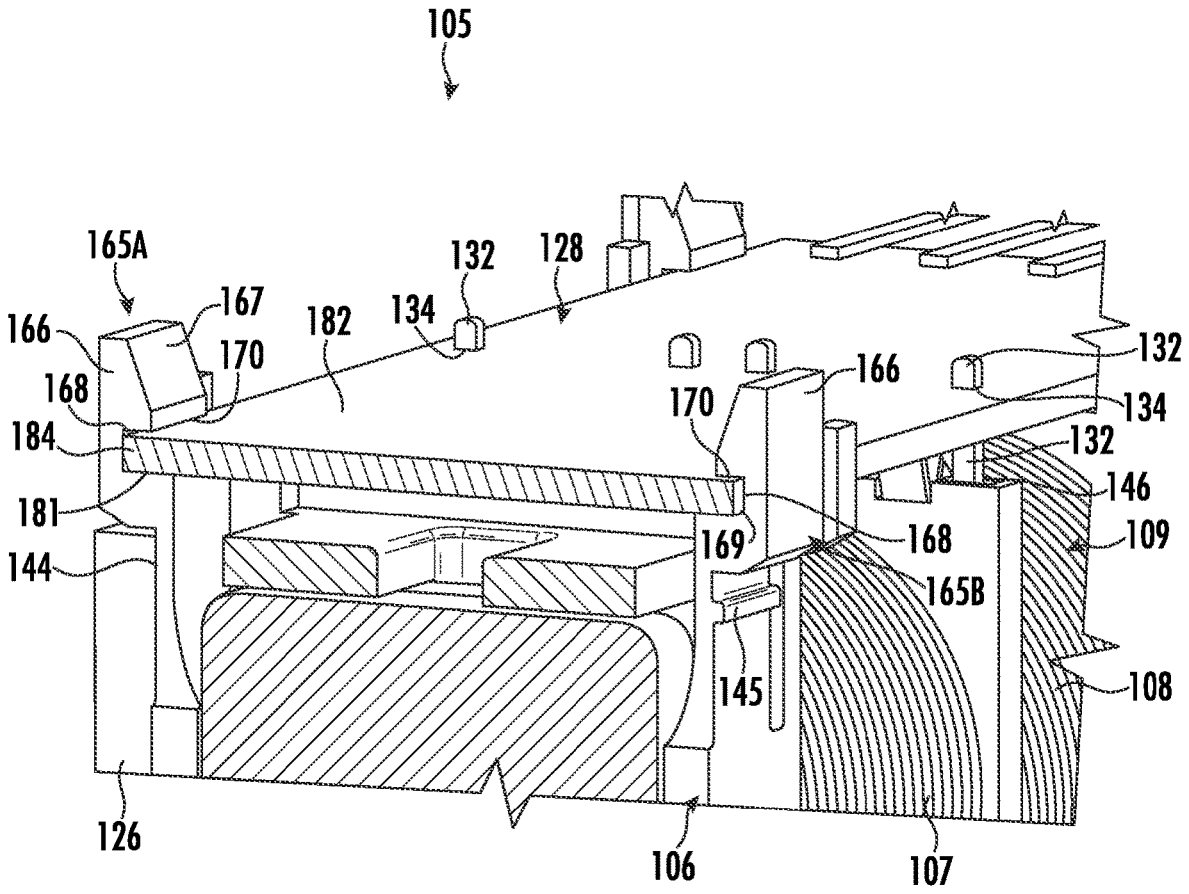
FIG. 4 depicts a perspective cross-sectional view of the core of the assembly of FIG. 1 according to embodiments of the present disclosure.

FIG. 4 further demonstrates connection between the PCB 128 and the support structure 106 according to embodiments of the present disclosure. The central section 109 of the support structure 106 may be sectioned by the separator plate 133, which is positioned between the first and second coils 107, 108. As shown, the separator plate 133 may include the plurality of slots or openings 146 operable to receive the conductive connectors 132. The conductive connectors 132 may be electrically connected to the first and second coils 107, 108 and to the PCB 128. As shown, the conductive connectors 132 may extend through corresponding PCB openings 134 of the PCB 128.

As shown, the fasteners 165A, 165B may each include the arm 166 operable to receive the PCB 128 within the retention slot 168 following engagement between the sloped engagement surface 167 and a perimeter 184 of the PCB 128. The retention slot 168 may be defined by the base surface 169 opposite the upper surface 170. Once the PCB 128 is positioned within the retention slots 168, the base surface 169 is operable to engage the first main side 181 of the PCB 128, while the upper surface 170 may be positioned directly adjacent, and/or in direct physical contact with, the second main side 182 of the PCB 128. The upper surface 170 may prevent the PCB 128 from being lifted away from the coil support structure 106, while the first and second shell components 125, 126, which are in contact with ridges 144 and ridges 145, may prevent the arms 166 from bending or deflecting away from the PCB 128.

Figure 5:
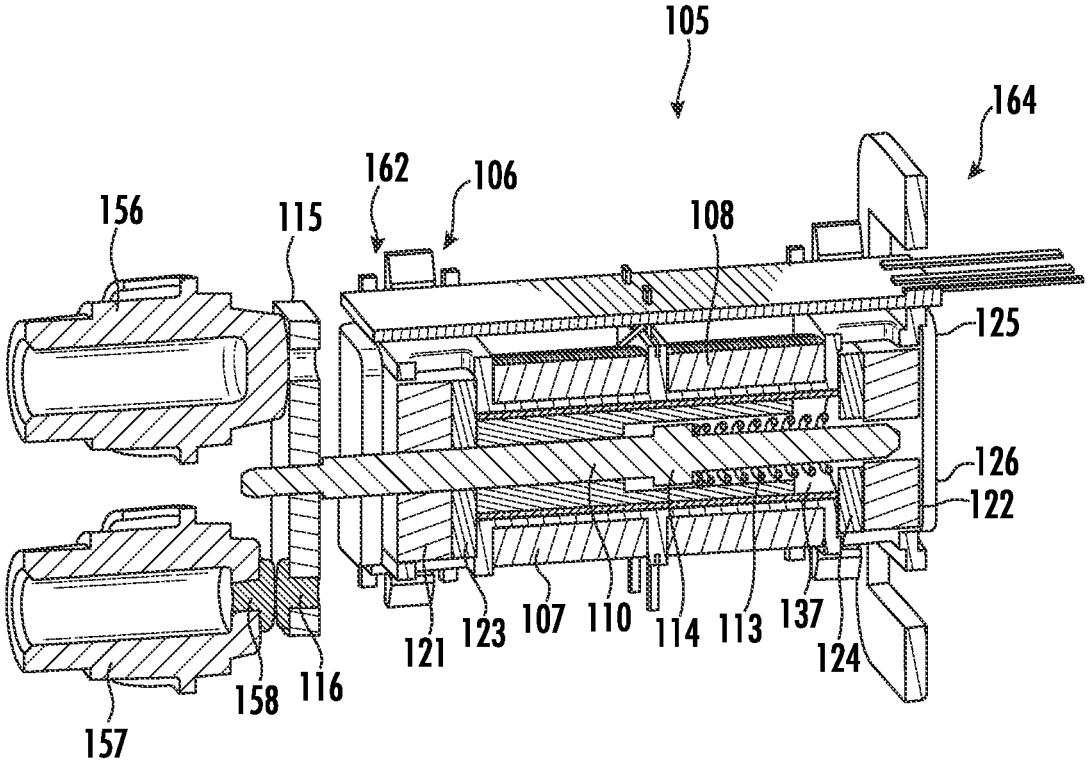
FIG. 5 depicts a side perspective cross-sectional view of the core of the assembly of FIG. 1 according to embodiments of the present disclosure.
Figure 6:
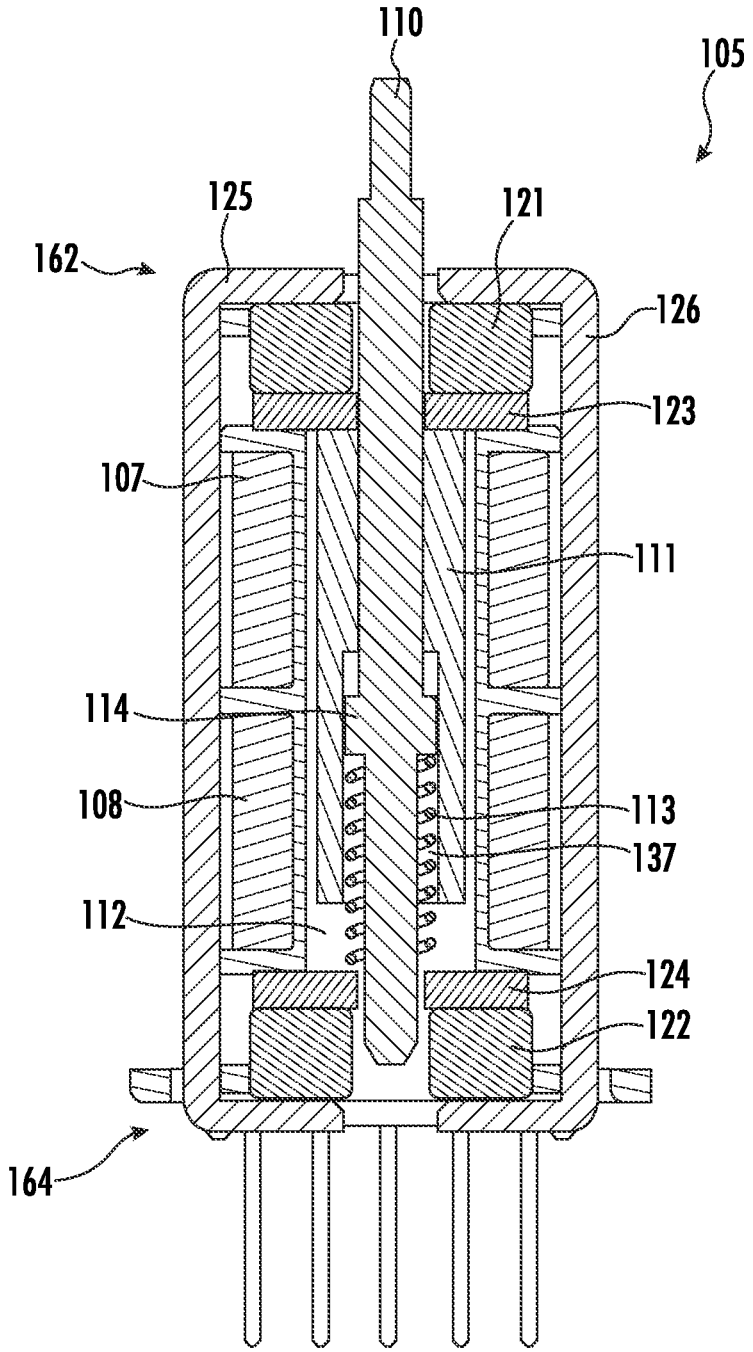
FIG. 6 depicts a side cross-sectional view of the core of the assembly of FIG. 1 according to embodiments of the present disclosure.

Turning now to FIGS. 5-6, the core assembly 105 will be described in greater detail. As shown, the plunger 110 may extend through the first magnet 121 and the first ferromagnetic plate 123 at a first end 162 of the support structure 106, and extend through the second magnet 122 and the second ferromagnetic plate 124 at a second end 164 of the support structure 106. The spring 113 may be positioned within an internal cavity 137 defined by the first core shaft 111 and the second core shaft 112. The spring 113 includes a first end in direct contact with the flange 114 of the plunger 110, and a second end in direct contact with the second ferromagnetic plate 124. The spring 113 is operable to bias the plunger 110 and the contact plate 115 towards corresponding contact components 156, 157 (FIG. 5). More specifically, the contact plate 115 and the plunger 110 are configured to make/break contact between contact 116 and contact 158. As shown, the first and second shell components 125, 126 are held in position by magnetic forces from the first and second magnets 121, 122.

During operation, when the first coil 107 is energized, the magnetic field moves the plunger 110 towards the contact components 156, 157, which may correspond to a closed position due to the positioning and connection of the contact (s) 116. When the second coil 108 is energized in the other direction, the magnetic field pulls the plunger 110 back towards the second end 164 of the support structure 106, where it is held (e.g., against the spring force) in place by the second magnet 122.

Although not shown, the assembly 100 may operate with a trigger circuit, which may include a condition detection module and may optionally include a power detection module. In some examples, the modules may be implemented using conventional analog, digital circuit, and/or programmable components. For example, the trigger circuit may be realized from a voltage detection circuit with a fixed width pulse generator. In some examples, a programmable integrated circuit (e.g., microprocessor, or the like) may be used to implement the modules. For example, a microprocessor may be programmed to monitor a first power rail for an interruption in power, and when an interruption in power is detected, the detection module may signal an actuator. This may be facilitated by using a microprocessor having a low voltage interrupt feature, wherein the low voltage interrupt is configured to detect a low voltage condition of the first power rail and send a signal (e.g., the interrupt) to the actuator via a signal line.

In some examples, the trigger circuit may include a comparator to detect the threshold voltage, which may then trigger a one-shot circuit to pulse the actuator for the correct amount of time. With some examples, an analog comparator on-board a microcontroller chip can be used to detect the threshold voltage while a timer can be used to control the pulse width. Some examples may include a brownout voltage detector operably connected to a comparator to generate an interrupt to a microcontroller.

Figure 7:
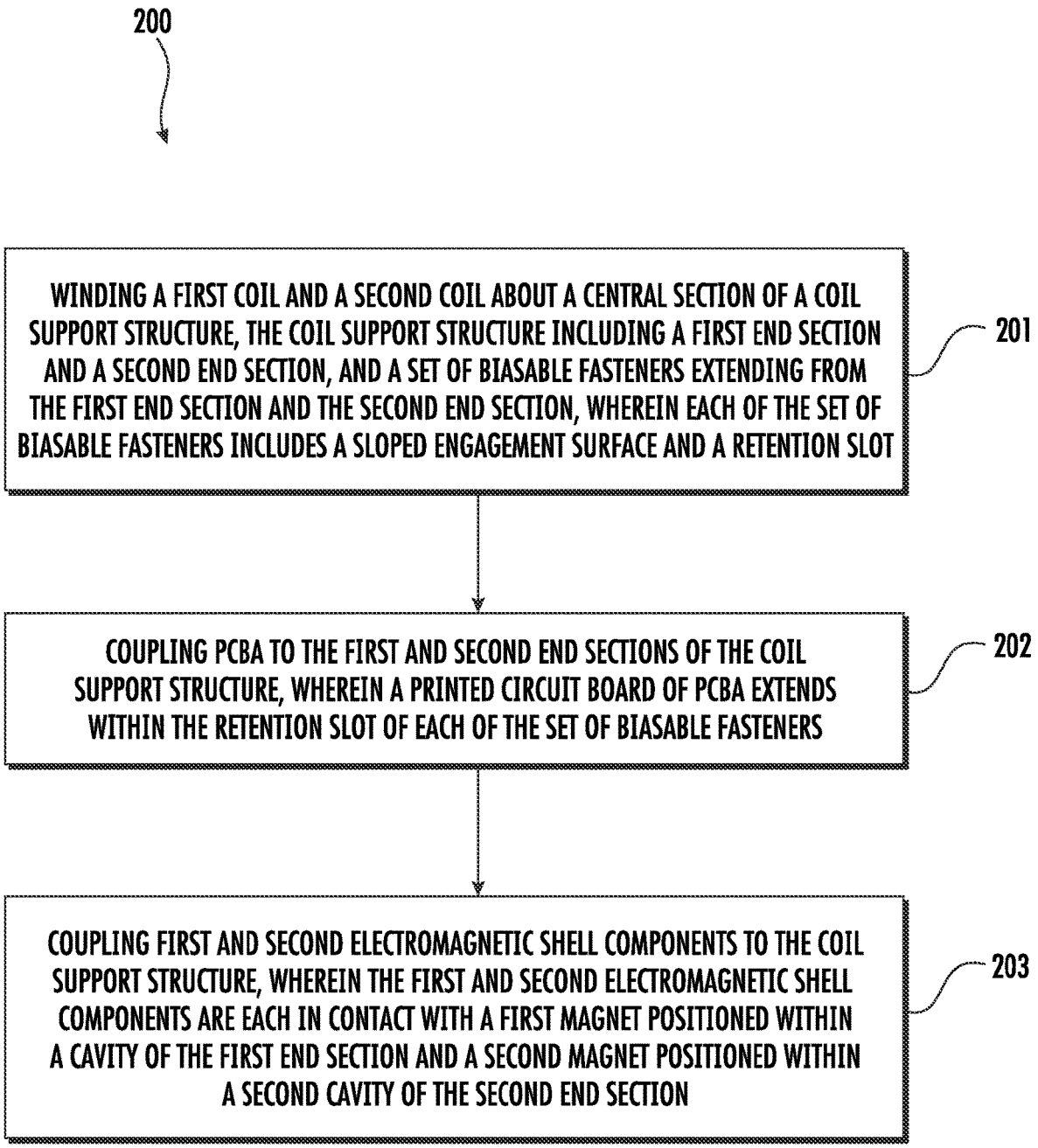
FIG. 7 is a flowchart depicting a method according to embodiments of the present disclosure.

Turning now to FIG. 7, a method 200 according to embodiments of the present disclosure is shown. At block 201, the method 200 may include winding a first coil and a second coil about a central section of a coil support structure, the coil support structure including a first end section and a second end section, and a set of biasable fasteners extending from the first end section and the second end section, wherein each of the set of biasable fasteners includes a sloped engagement surface and a retention slot.

At block 202, the method 200 may include coupling a PCBA to the first and second end sections of the coil support structure, wherein a printed circuit board of the PCBA extends within the retention slot of each of the set of biasable fasteners. In some embodiments, the method may include sliding a perimeter of the printed circuit board along the sloped engagement surface to deflect the set of biasable fasters away from one another. In some embodiments, the method may include positioning the printed circuit board atop a base surface of the retention slot.

At block 203, the method 200 may optionally include coupling a first electromagnetic shell component and a second electromagnetic shell component to the coil support structure, wherein the first electromagnetic shell component and the second electromagnetic shell component are each in contact with a first magnet positioned within a cavity of the first end section and a second magnet positioned within a second cavity of the second end. In some embodiments, the first and second electromagnetic shell components are each made from a ferromagnetic material, and may be held in position by magnetic forces from the first and second magnets.

As used herein, a module might be implemented utilizing any form of hardware, software, or a combination thereof. For example, one or more processors, controllers, ASICs, PLAs, logical components, software routines or other mechanisms might be implemented to make up a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Although various features or elements of functionality may be individually described or claimed as separate modules, one of ordinary skill in the art will understand these features and functionality can be shared among one or more common software and hardware elements.

For the sake of convenience and clarity, terms such as "top," "bottom," "upper," "lower," "vertical," "horizontal," "lateral," and "longitudinal" will be used herein to describe the relative placement and orientation of components and their constituent parts as appearing in the figures. The terminology will include the words specifically mentioned, derivatives thereof, and words of similar import.

As used herein, an element or operation recited in the singular and proceeded with the word "a" or "an" is to be understood as including plural elements or operations, until such exclusion is explicitly recited. Furthermore, references to "one embodiment" of the present disclosure are not intended as limiting. Additional embodiments may also incorporating the recited features.

Furthermore, the terms "substantial" or "substantially," as well as the terms "approximate" or "approximately," can be used interchangeably in some embodiments, and can be described using any relative measures acceptable by one of ordinary skill in the art. For example, these terms can serve as a comparison to a reference parameter, to indicate a deviation capable of providing the intended function. Although non-limiting, the deviation from the reference parameter can be, for example, in an amount of less than 1%, less than 3%, less than 5%, less than 10%, less than 15%, less than 20%, and so on.

While certain embodiments of the disclosure have been described herein, the disclosure is not limited thereto, as the disclosure is as broad in scope as the art will allow and the specification may be read likewise. Therefore, the above description is not to be construed as limiting. Instead, the above description is merely as exemplifications of particular embodiments. Those skilled in the art will envision other modifications within the scope and spirit of the claims appended hereto.

What is claimed is:

1. A bi-stable relay assembly, comprising:

a coil support structure, comprising:

a central section extending between a first end section and a second end section; and set of biasable fasteners extending from the first end section and the second end section, each of the set of biasable fasteners including a sloped engagement surface and a retention slot;

a first magnet and a first ferromagnetic plate within the first end section of the coil support structure; and a printed circuit board assembly (PCBA) coupled to the first and second end sections of the coil support structure, wherein the coil support structure extends within the retention slot of each of the set of biasable fasteners.

2. The bi-stable relay assembly of claim 1, each of the set of biasable fasteners further comprising an arm extending away from the central section along a first plane, wherein the sloped engagement surface is disposed along an inner side of the arm.

3. The bi-stable relay assembly of claim 2, wherein the sloped engagement surface extends along a second plane, and wherein the first plane and the second plane are oriented non-parallel to one another.

4. The bi-stable relay assembly of claim 2, each of the set of biasable fasteners further comprising a support post adjacent the arm.

5. The bi-stable relay assembly of claim 1, wherein the retention slot is defined by a base surface and an upper surface, wherein the base surface is in direct contact with a first main side of a printed circuit board of the PCBA, and wherein the upper surface is directly adjacent to a second main side of the printed circuit board.

6. The bi-stable relay assembly of claim 5, the central section of the coil support structure comprising a separator plate positioned between a first coil and a second coil.

7. The bi-stable relay assembly of claim 6, further comprising a plurality of conductive connectors coupled to the separator plate, wherein the first coil and the second coil are electrically connected with the plurality of conductive connectors.

8. The bi-stable relay assembly of claim 7, wherein one or more of the plurality of conductive connectors is coupled to the printed circuit board.

9. The bi-stable relay assembly of claim 7, wherein one of more of the plurality of conductive connectors extends through the printed circuit board.

10. The bi-stable relay assembly of claim 1, wherein each of the set of biasable fasteners is a snap-fit tab.

11. The bi-stable relay assembly of claim 1, further comprising:

a second magnet and a second ferromagnetic plate within the second end section of the coil support structure; and a first electromagnetic shell component and a second electromagnetic shell component each in contact with the first and second magnets.

12. The bi-stable relay assembly of claim 11, wherein the first and second end sections of the coil support structure each include a plurality of ribs, and wherein the first electromagnetic shell component and the second electromagnetic shell component are engaged with the plurality of ribs.

13. The bi-stable relay assembly of claim 12, further comprising:

a plunger extending through the coil support structure, between the first and second magnets;

a first core shaft surrounding the plunger, wherein a spring is positioned within the first core shaft, and wherein the spring is in contact with a flange of the plunger; and a second core shaft surrounding the first core shaft.

14. A coil support structure for a relay, comprising:

a central section extending between a first end section and a second end section, wherein a first coil and a second coil are operable to be wound about the central section; and set of biasable fasteners extending from the first end section and the second end section, each of the set of biasable fasteners including a sloped engagement surface and a retention slot, wherein a perimeter of a printed circuit board is operable to extend within the retention slot of each of the set of biasable fasteners, and wherein the first end section comprises a first end wall adjacent the set of fasteners extending from the first end section, the first end wall including an opening operable to receive the printed circuit board.

15. The coil support structure of claim 14, each of the set of biasable fasteners further comprising an arm extending away from the central section along a first plane, wherein the sloped engagement surface is disposed along an inner side of the arm, wherein the sloped engagement surface extends along a second plane, and wherein the first plane and the second plane are oriented non-parallel to one another.

16. The coil support structure of claim 14, wherein the retention slot is defined by a base surface and an upper surface, wherein the base surface is operable to be in direct contact with a first main side of the printed circuit board, and wherein the upper surface is operable to be positioned directly adjacent to a second main side of the printed circuit board.

17. The coil support structure of claim 14, the central section of the coil support structure comprising a separator plate positioned between a first coil and a second coil, wherein the separator plate is operable to receive a plurality of conductive connectors.

18. The coil support structure of claim 14, wherein each of the set of biasable fasteners is a snap-fit tab.

19. A method of assembling a bi-stable relay, comprising:

winding a first coil and a second coil about a coil support structure, the coil support structure comprising:

a central section extending between a first end section and a second end section, wherein the first and second coils are wound about the central section; and set of biasable fasteners extending from the first end section and the second end section, each of the set of biasable fasteners including a sloped engagement surface and a retention slot;

providing a first magnet and a first ferromagnetic plate within the first end section of the coil support structure; and coupling a printed circuit board assembly (PCBA) to the first and second end sections of the coil support structure, wherein a printed circuit board of the PCBA extends within the retention slot of each of the set of biasable fasteners.

20. The method of claim 19, further comprising sliding a perimeter of the printed circuit board along the sloped engagement surface to deflect the set of biasable fasters away from one another.

21. The method of claim 19, further comprising positioning the printed circuit board atop a base surface of the retention slot.

22. The method of claim 19, further comprising connecting one or more conductive connectors to the printed circuit board, wherein the one or more conductive connectors extend from a separator plate of the central section of the coil support structure.

23. The method of claim 19, further comprising coupling a first electromagnetic shell component and a second electromagnetic shell component to the coil support structure, wherein the first electromagnetic shell component and the second electromagnetic shell component are each in contact with the first magnet positioned within a cavity of the first end section and a second magnet positioned within a second cavity of the second end section.

* * * * *